United States Patent [19]

Thompson

[11] 4,240,451

[45] Dec. 23, 1980

[54] DIFFERENTIAL HAIR ENGAGEMENT RETAINER

[75] Inventor: Russell L. Thompson, Laguna Niguel, Calif.

[73] Assignee: Helen of Troy Corporation, El Paso, Tex.

[21] Appl. No.: 14,808

[22] Filed: Feb. 26, 1979

[51] Int. Cl.[3] ..... A45D 2/14
[52] U.S. Cl. ..... 132/42 A
[58] Field of Search ..... 132/40–42 R, 132/39

[56] References Cited

U.S. PATENT DOCUMENTS

| | | | |
|---|---|---|---|
| 2,604,893 | 7/1952 | Hoipo | 132/40 |
| 2,652,840 | 9/1953 | Isaacs et al. | 132/42 R |
| 2,747,585 | 5/1956 | Allen, Jr. | 132/42 |

*Primary Examiner*—G. E. McNeill
*Attorney, Agent, or Firm*—William W. Haefliger

[57] ABSTRACT

A differential hair engaging retainer to be used in combination with a hair roller, and comprised of stretchable means extending lengthwise of the hair roller for retainer hair about said roller and forming multiple spaces between said means and said roller, with or without hair extending therethrough, to permit lotions to pass therethrough in all positions of proximity of said stretchable means to said roller.

2 Claims, 10 Drawing Figures

DIFFERENTIAL HAIR ENGAGEMENT RETAINER

BACKGROUND OF THE INVENTION

This invention relates generally to hair waving devices, and more particularly concerns the provision of an elastomeric retaining band of differential cross sectional area with respect to its longitudinal axis for engaging and retaining hair about a hair roller.

Prior hair roller or permanent wave rod hair retaining bands suffered many inherent disadvantages. The line contact formed by prior hair retaining bands, of uniform cross section with respect to their longitudinal axis, with hair wound about a hair roller caused the hair to be squeezed between the band and roller, and thereby caused hair damage and impaired lotion flow to the squeezed hair. The impaired lotion flow also caused chemical concentrations to occur under the retaining band, thereby increasing the damage to hair proximate the retaining band. Further, the squeezing of hair between the band and the roller prevented uniform treatment and drying of hair wrapped about the hair roller. To my knowledge, no way was known to overcome these and other disadvantages, prior to the present invention.

SUMMARY OF THE INVENTION

It is a major object of the invention to provide a hair retaining band on a roller overcoming the above problems and also providing many additional advantages, as will appear. Basically, the hair retainer or retaining band is molded with differential cross sectional areas, with respect to its longitudinal axis along its length, and may be of single body construction. The retainer is preferably comprised of stretchable means extending lengthwise of a hair roller or permanent wave rod for retaining hair about the roller or rod and forming multiple spaces between the retainer and the roller or rod, with or without hair extending therethrough.

As will appear, this construction typically incorporates a series of cylindrical rod shaped portions between generally sperical bead shaped portions. The bead shaped portions serve to lift the rod shaped portions, that would otherwise comprise a uniform band, away from the surface of the roller to form spaces between the retainer and the roller. The spaces thus created minimize the pressure exerted on the hair to minimize hair damage; also the spaces allow lotions to freely flow about the hair retained under the band and also allow chemicals to be more effectively rinsed from the hair.

The retainer construction also incorporates end portions suitable for attachment and use in conjunction with many of the hair rollers and permanent wave rods presently in use. Being constructed of stretchable material, the retainer also is usable with many sizes and shapes of hair rollers.

The ability to effect uniform treatment of the hair as well as other objects and advantages of the invention will be more fully understood from the following description and drawings, in which:

DRAWING DESCRIPTION

DETAILED DESCRIPTION

Figure 1:
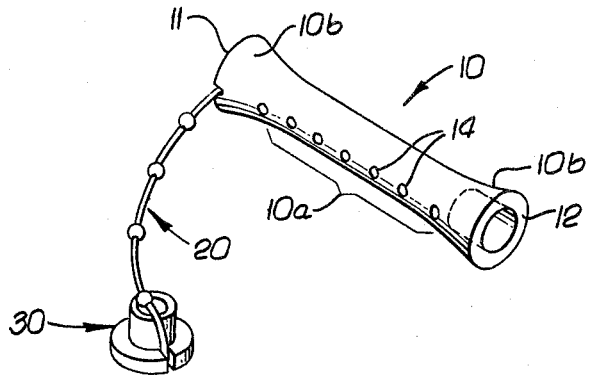
FIG. 1 is a perspective of a stretchable band incorporating the invention, attached to a permanent wave rod.

The apparatus in FIG. 1 includes a necked cylindrical roller 10 known as permanent wave rod, which may comprise lightweight plastic material, and may have reduced diameter extend 10*a* between somewhat enlarged flaring ends 10*b* to provide wound hair storage space. In each of FIGS. 1, 4, 5 and 8 the roller is shown as including a row of perforations 14 which serve to drain any excess liquid reagent. Attached to one end 11 of the roller is one end 21 of a differential hair roller engaging and retaining band 20. The other end 12 of the roller 10 may incorporate a removeably fitting plastic plug 30, to which the opposite end 22 of the retaining band 20 is attached.

Figure 4:
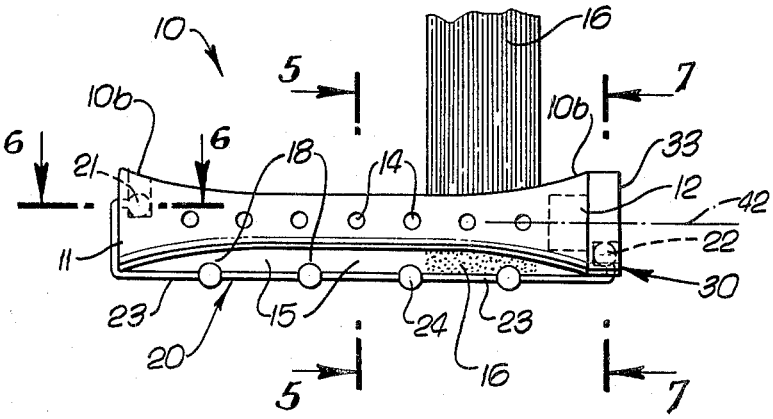
FIG. 4 is a side elevation of the FIG. 1 device showing hair retained about the permanent wave rod.
Figure 5:
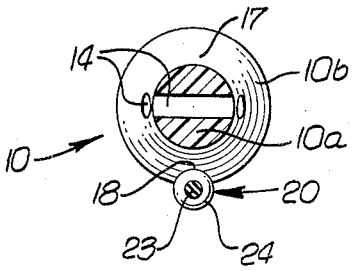
FIG. 5 is an end view taken in section along lines 5—5 of FIG. 4.

FIG. 4 shows the configuration of the apparatus as it would be in use, with hair wound in place. The retaining band 20 is of such a length that it is in a somewhat stretched condition when it is both attached to the end of the roller 11 and to the plug 30, when the plug is fitted to the other end 12 of the roller 10.

Figure 2:
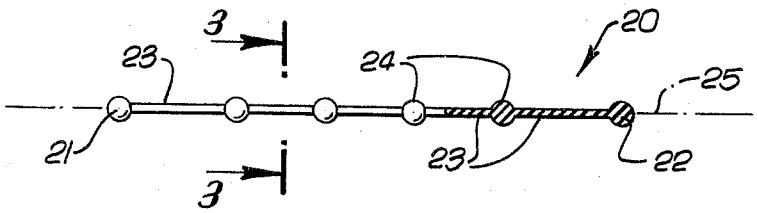
FIG. 2 is a side view of the FIG. 1 band, partially in section.
Figure 3:
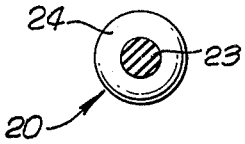
FIG. 3 is an enlarged end view taken in section on lines 3—3 of FIG. 2.
Figure 9:
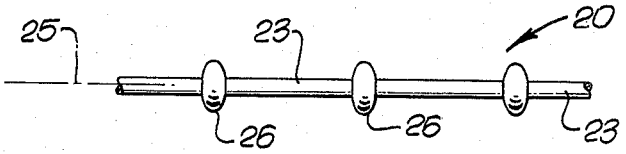
FIG. 9 is a side view of an alternate form of band.

As is shown in FIGS. 2 and 3, the stretchable retaining band means 20 is comprised of stretchable material, rubber or other elastomer for example, that consists of a series of first portions 23 and second portions 24. In this example, the first portions 23 are rod-like cylinders which, in the absence of the second portions 24 would comprise a band or cord of uniform cross sectional area with respect to the longitudinal axis 25. The second portions 24 typically consist of generally spherical beads of larger cross sectional area than the portions 23. An alternative second portion, in place of the spherical construction, shown in FIG. 9, uses a beadlike portion that has a generally oval shaped cross section 26 in all planes that intersect the longitudinal axis 25 of the retainer 20.

The incorporation of second portions 24 on an otherwise uniform band 20 creates multiple spaces 15 between portions 24, the band serving to retain hair 16 in a wound condition about the roller 10. The creation of such multiple spaces 15 allows the hair to be retained in a wound condition with the additional advantages of the capability of hair treating lotion to pass freely about hair 16 that is retained in those spaces 15 irrespective of the closeness of the band to the roller. The non-uniform cross section of the retainer along its length with respect to its longitudinal axis 25 provides for, at most, local convex contact at 18 between multiple second portions 24 and the roller 10 or hair 16. The elimination of line contact where the otherwise uniform bands contacts the hair 16 allows lotion to freely pass along the hair, and minimizes kinks and lines in the resulting curled hair.

For simplicity of manufacture, the band end portions 21 and 22 referred to above may have generally spherical beadlike construction similar to that of the second portions 24, described above, and are attached or molded integrally with respective first portions 23.

Figure 6:
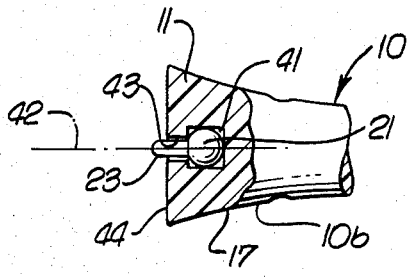
FIG. 6 is a side view taken in section along lines 6—6 of FIG. 4.
Figure 7:
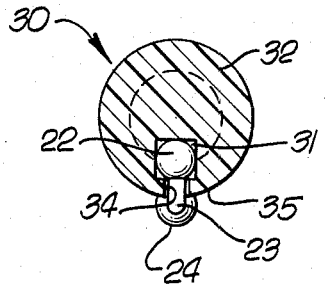
FIG. 7 is an end view taken in section along lines 7—7 of FIG. 4.
Figure 8:
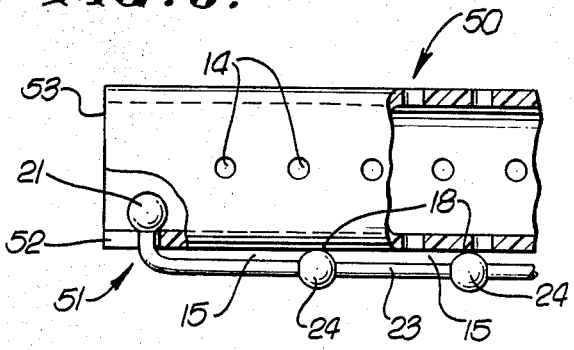
FIG. 8 is a side view of a stretchable band incorporating the invention and attached to a different form of hair roller.

Further, the end portions 21 and 22 are compatible with the typical attachment means depicted in FIGS. 4, 6 and 7. The construction shown in FIG. 6 consists of a recess 41 extending radially inward with respect to the longitudinal axis 42 of the roller, partially into the roller from the surface 17 of the end portion 11 of the roller 10. The recess 41 is sized to accommodate the end portion 21 of the retainer band 20, and has a slit 43 extending from the recess 41 to the end face 44 of the end portion 11. Slit 43 is sized to accommodate a retainer first portion 23 while restricting passage therethrough of a retainer beadlike end portion 21, integral with said first portion 23.

The construction shown in FIG. 7 has similar attaching means as that shown in FIG. 6 except that it is included in the plug 30. As shown, a recess 31 extends partially into the cap 32 of the plug 30 from the end face 33 and parallel to the longitudinal axis 42 of the roller 10 and plug 30 combination. That recess 31 is sized to accommodate the other beadlike end portion 22 of the retainer 20, and has a slit 34 extending from the recess 31 to the radially outwardly edge 35 of the plug 30. Slit 34 and recess 31 are sized and function with similarity to the recess 41 and slit 43 described above, to accommodate end portion 22 of the retainer and its respective integral first portion 23.

It is intended that the invention be capable of being used in conjunction with both a permanent wave rod type of hair roller 10 shown in FIGS. 1, 4–7 and a generally cylindrical hair roller. The typically tubular roller 50 shown in FIG. 8 includes end means 51 adapted for use with the end portions 21 and 22 of a retainer band 20. Said means 51 consists of a slit 52 extending from the end face 53 partially into the roller 50. Slit 52 is sized to accommodate a first portion 23 of a retaining band 20 while restricting passage therethrough of a retainer end portion 21 or 22 integral with said first portion 23, such that end portion 21 or 22 is retained generally interiorly of the tubular roller 50.

Figure 10:
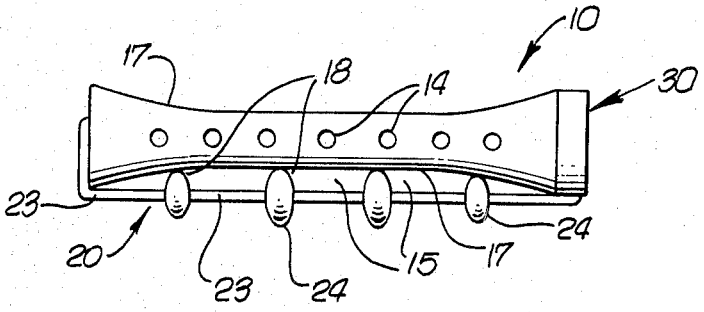
FIG. 10 is a side view of another alternate form of band attached to a permanent wave rod.

One considered variation of the invention shown in FIG. 10 incorporates beadlike second portions 24 of varying cross sectional area with respect to the longitudinal axis 25 so that localized convex contact 18 is maintained between multiple second portions 24 of the band 20 and the concave surface 17 of the permanent wave rod 10.

It should be noted that the above is a description of only certain preferred embodiments of the invention and that the scope of the invention is more accurately specified as in the following claims.

I claim:

1. A differential hair engaging retainer to be used in combination with a hair roller, and comprised of a stretchable elastomeric band extending lengthwise of the hair roller for retaining hair about said roller, the band including multiple alternating beads and rods located along the band length and forming multiple spaces between the band and said roller and between the beads, with or without hair extending therethrough, to permit lotions to pass therethrough in all positions of proximity of said stretchable band to said roller, the beads having substantially larger cross-sectional areas than the rods presented toward the roller to seat on hair wrapped about the roller.

2. The combination of claim 1 wherein said beads are generally oval-shaped in cross sections taken in planes through a common axis defined by the rods, the beads extending toward the roller for contact therewith.

* * * * *